US012704336B1

(12) United States Patent
Smith

(10) Patent No.: US 12,704,336 B1
(45) Date of Patent: Aug. 11, 2026

(54) HEAT SHIELD FOR FIREARM SUPPRESSORS AND METHOD

(71) Applicant: Michael L. Smith, Alpharetta, GA (US)

(72) Inventor: Michael L. Smith, Alpharetta, GA (US)

( * ) Notice: Subject to any disclaimer, the term of this patent is extended or adjusted under 35 U.S.C. 154(b) by 0 days.

(21) Appl. No.: 19/033,253

(22) Filed: Jan. 21, 2025

Related U.S. Application Data

(60) Provisional application No. 63/624,117, filed on Jan. 23, 2024.

(51) Int. Cl.

| | |
|---|---|
| ***F41A 13/12*** | (2006.01) |
| ***F41A 21/24*** | (2006.01) |
| ***F41A 21/30*** | (2006.01) |
| ***F41A 21/44*** | (2006.01) |

(52) U.S. Cl.
CPC ..... *F41A 13/12* (2013.01); *F41A 21/24* (2013.01); *F41A 21/30* (2013.01); *F41A 21/44* (2013.01)

(58) Field of Classification Search
CPC ..... F41A 21/30; F41A 21/44; F41A 13/12; F41A 21/24
See application file for complete search history.

(56) References Cited

U.S. PATENT DOCUMENTS

| | | | | |
|---|---|---|---|---|
| 6,575,074 | B1 | 6/2003 | Gaddini | |
| 8,015,908 | B2 | 9/2011 | Kline et al. | |
| 8,171,840 | B2 | 5/2012 | Kline et al. | |
| 8,967,325 | B1 | 3/2015 | Cronhelm | |
| 9,115,950 | B2 | 8/2015 | Bethlenfalvy | |
| 9,482,483 | B2 | 11/2016 | Whelan | |
| 9,658,010 | B1 * | 5/2017 | Oglesby | F41C 23/16 |
| 9,933,223 | B2 | 4/2018 | Latka | |
| 10,036,606 | B2 * | 7/2018 | Roberts | F41A 21/44 |
| 10,126,084 | B1 | 11/2018 | Oglesby | |
| 10,371,476 | B1 | 8/2019 | Oglesby | |
| D859,566 | S | 9/2019 | Mooty et al. | |
| 10,466,003 | B2 * | 11/2019 | Thompson | F41A 21/24 |
| 10,712,114 | B2 * | 7/2020 | Roberts | F41A 13/12 |
| 10,866,051 | B2 * | 12/2020 | Thompson | F41A 21/24 |
| 11,150,045 | B1 * | 10/2021 | Oglesby | F41A 21/30 |
| 11,493,297 | B2 | 11/2022 | Wilson | |

(Continued)

FOREIGN PATENT DOCUMENTS

| | | | | |
|---|---|---|---|---|
| FI | 20217025 A1 * | 8/2022 | | F41H 1/00 |
| GB | 2281119 A * | 2/1995 | | F41A 21/30 |

OTHER PUBLICATIONS

Machine Translation of Kangasniemi. FI 20217025 A1. Aug. 3, 2022. (Year: 2022).*

*Primary Examiner* — Gabriel J. Klein
(74) *Attorney, Agent, or Firm* — Charmasson, Buchaca & Leach, LLP

(57) ABSTRACT

A heat dissipation promoting ventilated protective guard for a firearm suppressor also known as a moderator can include a substantially cylindrical cage shaped body surrounding an inner void that can contain the suppressor. In inwardly projecting beveled stop-surface on the guard bears against a corresponding beveled shoulder on the suppressor to limit axial movement. A snap-ring and wave spring bias the guard against the shoulder. Slits and vents in the mounted guard allow air to pass over the suppressor and prevent contact by a user with a dangerously hot suppressor.

13 Claims, 5 Drawing Sheets

(56) References Cited

U.S. PATENT DOCUMENTS

| | | | | |
|---|---|---|---|---|
| 11,644,265 | B1 * | 5/2023 | Oglesby | F41A 21/44 89/14.4 |
| 11,674,771 | B2 | 6/2023 | Wilson | |
| 11,920,884 | B1 * | 3/2024 | Lee | F41A 21/34 |
| 12,449,220 | B1 * | 10/2025 | Russell | F41A 21/44 |
| 2005/0115394 | A1 * | 6/2005 | Matthews | F41A 21/325 89/14.4 |
| 2014/0059913 | A1 * | 3/2014 | Diamond | F41C 27/00 42/90 |
| 2015/0082679 | A1 * | 3/2015 | Michal | F41C 23/16 42/71.01 |
| 2015/0090105 | A1 | 4/2015 | Pace | |
| 2015/0241159 | A1 * | 8/2015 | Michal | F41A 21/44 89/14.4 |
| 2015/0260472 | A1 * | 9/2015 | Smith | F41A 21/30 89/14.2 |
| 2016/0153734 | A1 * | 6/2016 | Oliver | F41A 21/24 89/14.1 |
| 2017/0153080 | A1 * | 6/2017 | Roberts | F41A 21/44 |
| 2017/0299313 | A1 * | 10/2017 | Adamson, Jr. | F41A 21/30 |
| 2018/0292164 | A1 * | 10/2018 | Thompson | F41A 21/36 |
| 2018/0306546 | A1 * | 10/2018 | Roberts | F41A 13/12 |
| 2020/0284541 | A1 * | 9/2020 | Poling | F41A 21/30 |
| 2021/0041200 | A1 * | 2/2021 | Kras | F41A 21/30 |
| 2021/0404761 | A1 * | 12/2021 | Le Sage | F41A 21/44 |
| 2022/0120528 | A1 * | 4/2022 | Muceus | B33Y 40/20 |
| 2023/0194201 | A1 * | 6/2023 | Muceus | F41A 21/44 89/14.05 |
| 2024/0310137 | A1 * | 9/2024 | Brace | F41A 21/325 |

* cited by examiner

HEAT SHIELD FOR FIREARM SUPPRESSORS AND METHOD

PRIOR APPLICATION

This application claims the benefit of U.S. Provisional Patent Application Ser. No. 63/624,117, filed 2023 Jan. 23, incorporated herein by reference.

FIELD OF THE INVENTION

The instant invention relates to firearm sound suppressors and more particularly to devices for improving the function of existing suppressors.

BACKGROUND OF THE INVENTION

Firearms such as guns have long been in use for hunting, target shooting, and as weapons. The sound associated with the discharge of gasses out the muzzle of a firearm, known as the report, can be very loud, often at levels damaging to the hearing of persons nearby including the operator firing the firearm. Sound suppressors, known more colloquially as silencers, have been used for decades on many types of firearms from pistols to high power rifles to reduce the sound level of the report.

One type of suppressor, as shown in Gaddini, U.S. Pat. No. 6,575,074 incorporated herein by reference, uses a series of cylindrical, axially connected baffle structures mounted at the discharging end of a firearm muzzle. The firearm projectile travels down a central cylindrical bore through the axially arranged baffles. Radially outward from the bore are a series of interconnected expansion chambers for capturing and slowing the discharge gasses accompanying and following the projectile. The chambers allow the pressure of the captured gasses to slowly dissipate within the suppressor. By the time the gasses are released from the suppressor, they are traveling at such a slow speed that their sound, and thus the loudness of the report, is greatly reduced.

Various problems are encountered by baffle-type suppressors. Because they dissipate the energy of the hot discharge gasses, the suppressors get hot, especially after firing multiple rounds in close succession. This can make the outer shell of a suppressor dangerously hot, potentially leading to burns when inadvertently touched by users.

Some prior suppressors, such as Oglesby, U.S. Pat. No. 11,150,045 provide heat shields but can suffer from difficulties in installation, and slow heat dissipation.

Traditionally, suppressors have been manufactured through a variety of means such as machining material to form individual components which then can attached together by welding or other means of fastening. Alternatively, a single cored baffle can be machined or cast from a material which is then secured by welding or other means within a hollow outer body.

Newly developed three-dimensional printing techniques have also been used in the manufacturing of suppressors such as in Wilson, U.S. Pat. No. 11,493,297. In these processes, called additive layer manufacturing, a metal powder is distributed onto a substrate and a laser is used to heat the powder to fuse the individual powder particles together to form a portion of the component. This process is repeated until the full component is formed. These additive layer manufacturing processes inherently involve a number of issues such as the need for a support or substrate for the powder to rest on and the stress of the heat from the laser warping or otherwise affecting the already formed layers of the component.

Therefore, there is a need for a firearm suppressor heat shield which addresses some or all of the above identified inadequacies.

SUMMARY

The principal and secondary objects of the invention are to provide an improved firearm suppressor heat shield. These and other objects are achieved by a well-ventilated heat shield having improved mounting.

In some embodiments there is provided the combination of a ventilating heat guard coaxially mounted to a firearm suppressor; wherein said suppressor comprises: an oblong outer shell having a central axial bore allowing the passage of a projectile therethrough from a proximal end to a distal end; a radially outwardly projecting peripheral beveled shoulder; wherein said heat guard comprises: a body having an inner void shaped and dimensioned to accommodate said suppressor; said body having a proximal opening to said void and a distal opening to said void; a radially inwardly projecting beveled stop surface; wherein said beveled stop surface bears against said beveled shoulder, preventing axial movement of said guard with respect to said suppressor in a first axial direction.

In some embodiments said combination further comprises: a disk-shaped axial bearing surface located near said proximal opening; and wherein said suppressor further comprises: a circumferential groove near said proximal end; a snap-ring resting within said groove; a wave spring compressed between said snap-ring and said axial bearing surface.

In some embodiments said combination further comprises: said axial bearing surface being located with a well extending distally from a distal end of said guard.

In some embodiments said combination further comprises: said beveled shoulder having a first bevel angle; said beveled stop surface having a second bevel angle; wherein a sum of said first bevel angle and said second bevel angle is substantially 90 degrees.

In some embodiments said first and second bevel angles are substantially 45 degrees.

In some embodiments said combination further comprises: said suppressor further comprising: a proximal journal; a distal journal axially spaced apart from said proximal journal; said guard further comprising: a proximal bearing supported upon said proximal journal; a distal bearing supported upon said distal journal.

In some embodiments said combination further comprises: said proximal bearing having a proximal bearing inner diameter; said distal bearing having a distal bearing inner diameter; said proximal journal having a proximal journal outer diameter commensurate with said proximal bearing inner diameter; said distal journal having a distal journal outer diameter commensurate with said distal bearing inner diameter.

In some embodiments said combination further comprises: said proximal bearing having a first plural number of radially inwardly projecting angularly spaced apart proximal stand-off spokes; said distal bearing having a second plural number of radially inwardly projecting angularly spaced apart distal stand-off spokes separating distal ventilation gaps.

In some embodiments said combination further comprises: said guard further comprising a plurality of axially oblong angularly spaced apart slits extending radially through said body from an outer surface to said void; wherein said slits are located distal to said beveled stop-surface.

In some embodiments said combination further comprises: said suppressor further comprising a heat radiator structure formed on said outer shell; said guard further comprising said slits being located radially outward from said heat radiator structure.

In some embodiments said combination further comprises: said guard further comprising a plurality of angularly spaced apart radial vents extending through said body to said inner void; wherein said vents are located proximal to said beveled stop surface.

In some embodiments said combination further comprises: said guard further comprising a plurality of angularly spaced apart inwardly extending radial lugs located near a proximal end of said guard; said suppressor further comprising a plurality of notches engaged by said lugs; thereby preventing angular movement of said guard with respect to said suppressor.

In some embodiments each of said lugs comprises a radially inward facing surface having a first angular dimension that is wider than an angular dimension of a more radially outward portion of said lug.

In some embodiments there is provided a method for protecting a user from burns by a firearm suppressor, said method comprises: selecting a suppressor having an outer shell having a beveled shoulder; selecting a guard having an inner void that can accommodate said suppressor, and having complimentary beveled stop-surface extending into said void; aligning said guard angularly with said suppressor so that angular alignment structures line up; inserting coaxially a proximal end of said suppressor into a distal opening of said guard until said beveled shoulder contacts said beveled stop-surface; locking the axial position of said suppressor with respect to said guard; firing said firearm until said suppressor becomes dangerously hot; and, touching the guard without being burned.

The original text of the original claims is incorporated herein by reference as describing features in some embodiments.

DESCRIPTION OF THE EXEMPLARY EMBODIMENTS

In this specification, the references to top, bottom, upward, downward, upper, lower, vertical, horizontal, sideways, lateral, back, front, proximal, distal, etc. can be used to provide a clear frame of reference for the various structures with respect to other structures typically while the device is oriented on its side, and not treated as absolutes when the frame of reference is changed, or when the device is oriented differently.

In this specification, features described in connection with one embodiment may be applicable to the other embodiments depending on their functional requirements and restrictions. Those skilled in the art will readily appreciate that applicability.

If used in this specification, the term "substantially" can be used because manufacturing imprecision and inaccuracies can lead to non-symmetricity and other inexactitudes in the shape, dimensioning and orientation of various structures. Further, use of "substantially" in connection with certain geometrical shapes, such as "triangular", "wedge-shaped" and "cylindrical", and orientations, such as "parallel" and "perpendicular", can be given as a guide to generally describe the function of various structures, and to allow for slight departures from exact mathematical geometrical shapes and orientations, while providing adequately similar function. Those skilled in the art will readily appreciate the degree to which a departure can be made from the mathematically exact geometrical references.

If used in this specification, the word "axial" is meant to refer to directions, movement, or forces acting substantially parallel with or along a respective axis, and not to refer to rotational nor radial nor angular directions, movement or forces, nor torsional forces.

In this specification the units "millimeter" or "millimeters" can be abbreviated "mm", "centimeter" or "centimeters" can be abbreviated "cm", and "milligram" or "milligrams" can be abbreviated "mg". Units of temperature such as "degrees centigrade" can be abbreviated "° C.".

Figure 1:
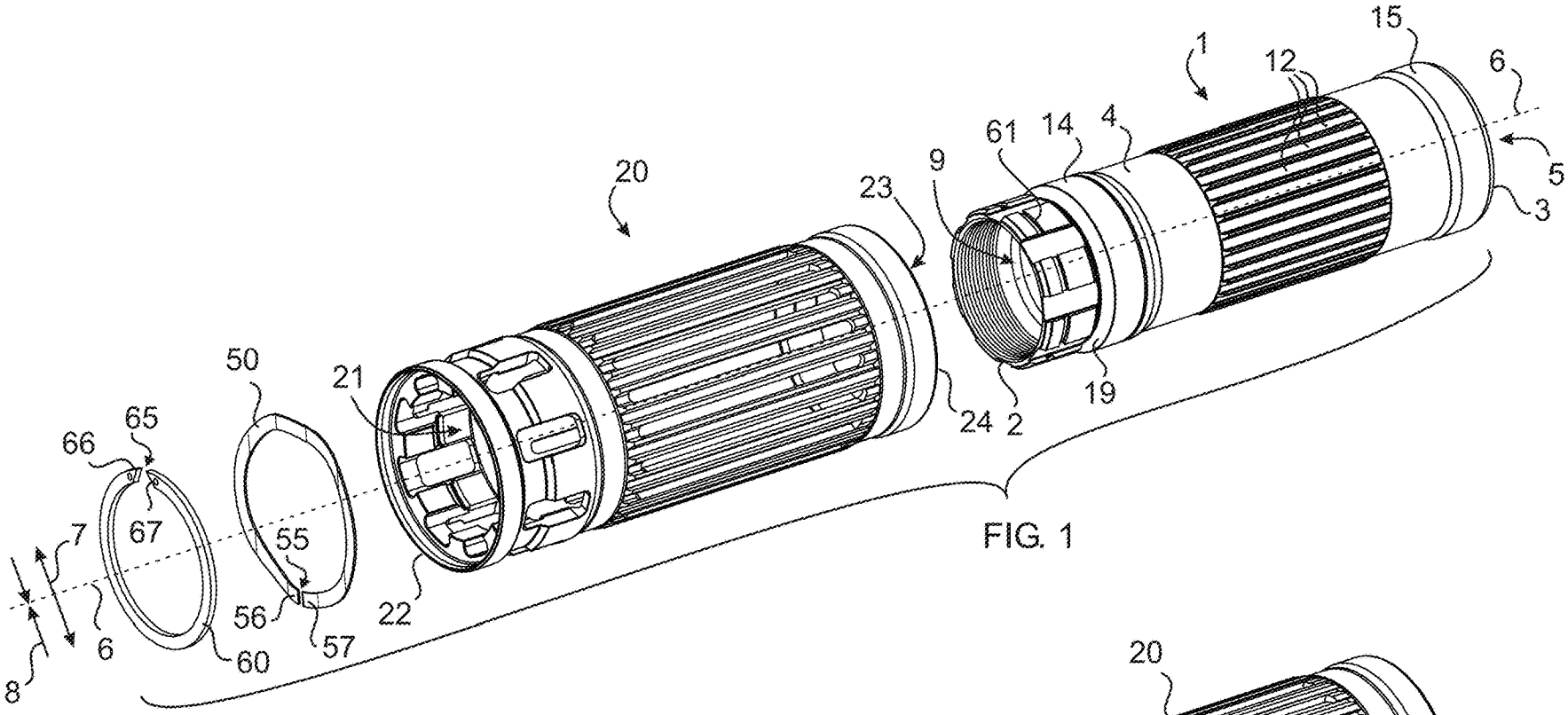
FIG. 1 is a diagrammatic exploded top, back, right side perspective view of a firearm suppressor and ventilating heat shield according to an exemplary embodiment of the invention.
Figure 2:
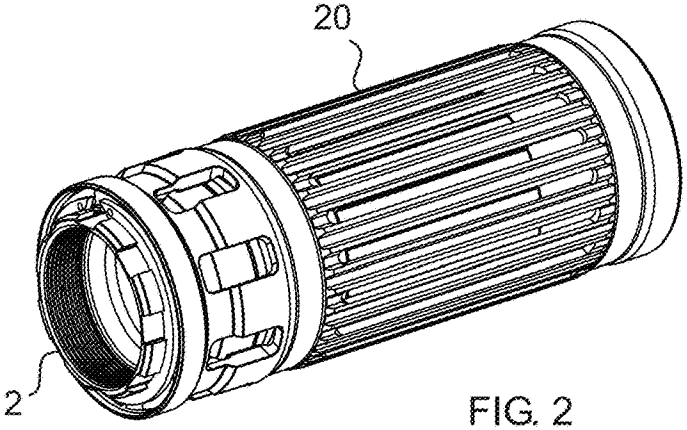
FIG. 2 is a diagrammatic top, back, right side perspective view of the assembled suppressor and ventilating heat shield of FIG. 1.
Figure 3:
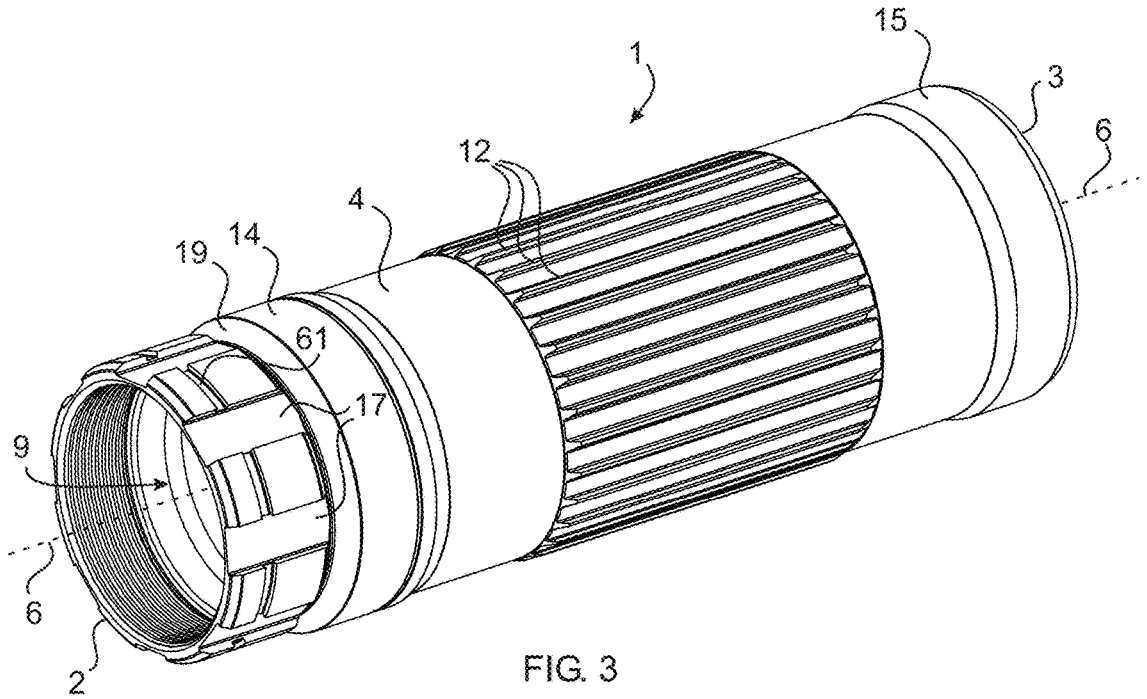
FIG. 3 is a diagrammatic top, back, right side perspective view of the firearm suppressor of FIG. 1.

Referring to FIG. 1, in this specification the terms "distal" and "forward", and "proximal" and "rearward" are used to indicate relative axial positioning with respect to the suppressor 1 and the travel of a projectile. The projectile always travels distally or forwardly from the rear, back or proximal end 2 of the suppressor toward its front or distal end 3 along the axis 6 of the suppressor. Proximal or rearward is the opposite direction from distal. The radially outward direction is indicated by arrow pair 7; and, the radially inward direction is indicated by arrow pair 8.

The suppressor and/or shield components can be produced monolithically through a three dimensionally printed additive layer manufacturing process wherein the resultant structure may or may not be further machined. For ease of description, the components are shown and described as an amalgam of potentially separate individual parts, but those skilled in the art will readily appreciate the overarching monolithic structure where applicable.

Referring now to the drawing, there is shown in FIGS. 1-4 a suppressor 1 and a mountable heat dissipation accommodating shield or guard 20 according to an exemplary embodiment of the invention. The assembled suppressor can have a generally cylindrically shaped body having a substantially cylindrical housing or outer shell 4 surrounding a central bore which extends along an axis 6 from a proximal inlet 9 at the proximal end 2 which can attach either directly or indirectly to the muzzle of a firearm, to a distal outlet 5 at the distal end 3 from which exits a fired projectile. During firing a projectile or bullet is propelled by pressurized gasses to move distally through the bore heating up the suppressor including its outer shell 4. The outer shell can have a number of angularly spaced apart axially oblong ridges 12 that can act as a heat radiating structure and also serve a high friction grasping surface to hand-apply torque to the suppressor.

Figure 4:
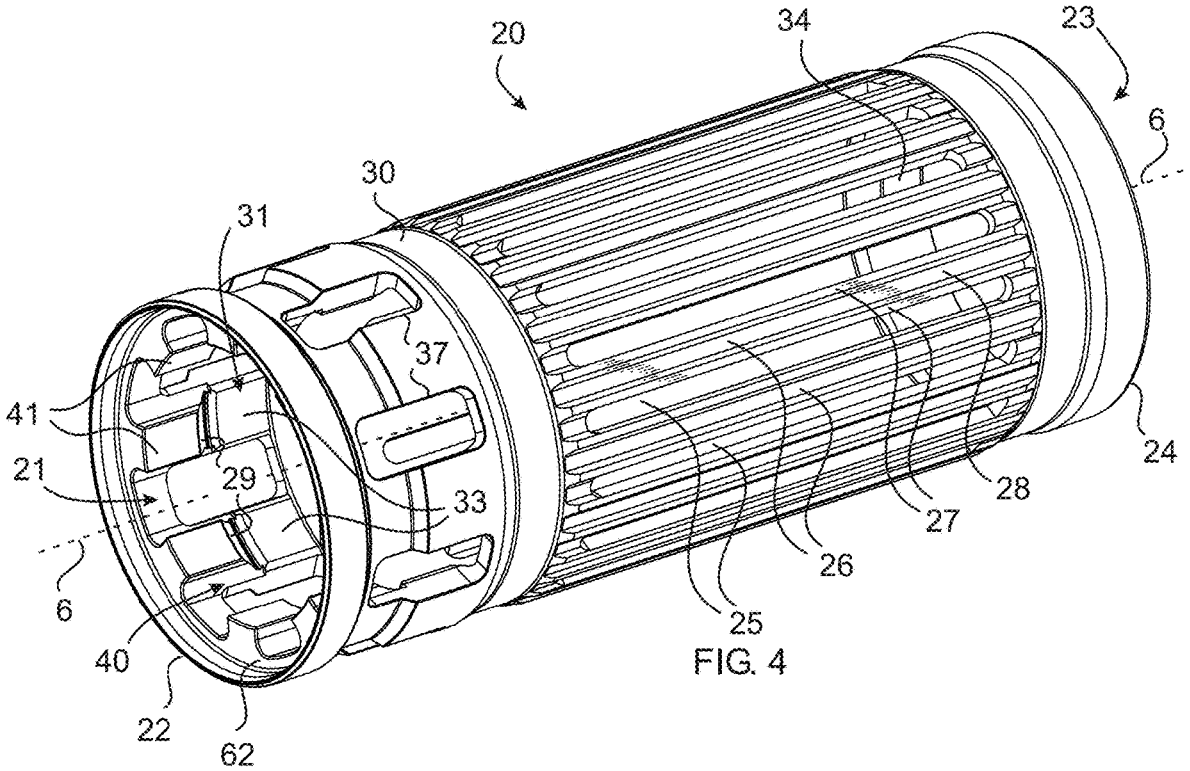
FIG. 4 is a diagrammatic top, back, right side perspective view of the ventilating heat shield of FIG. 1.
Figure 5:
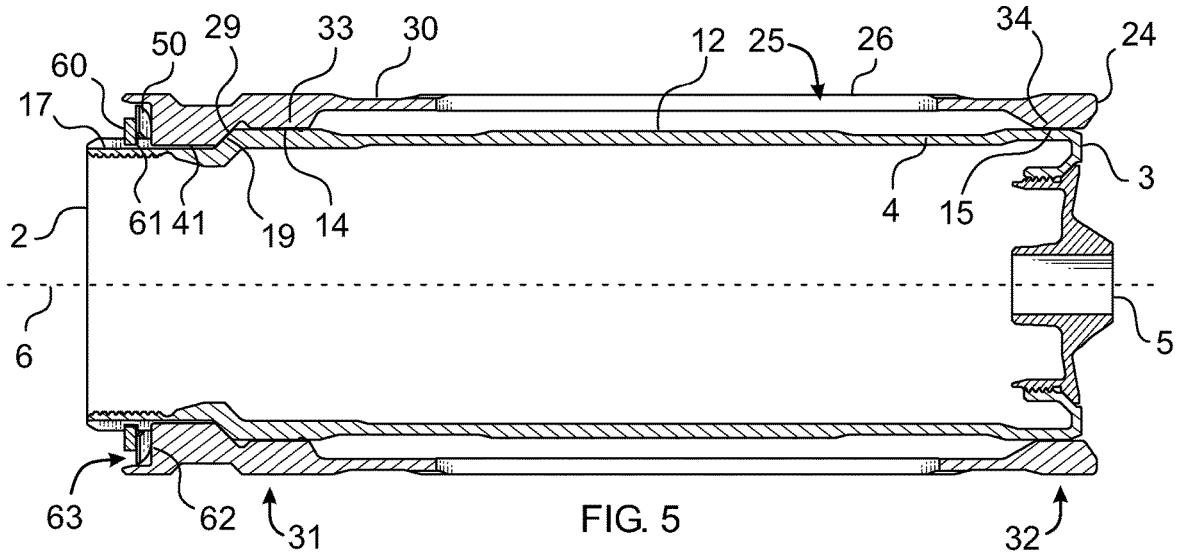
FIG. 5 is a diagrammatic cross-sectional side view of the suppressor and ventilating heat shield of FIG. 2.
Figure 6:
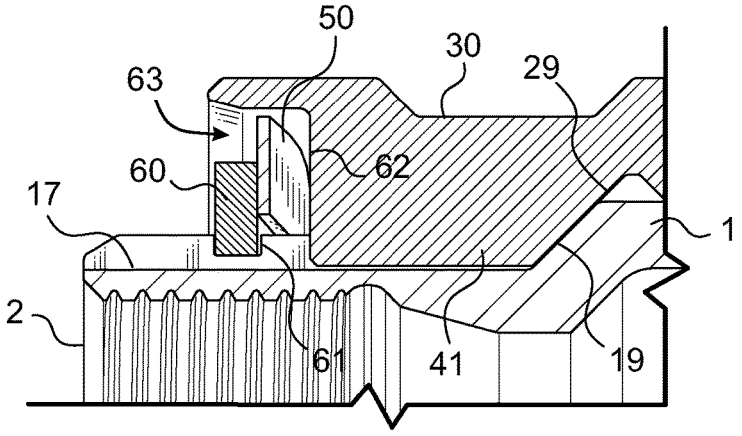
FIG. 6 is a diagrammatic enlarged cross-sectional partial side view of the proximal end suppressor and ventilating heat shield of FIG. 5.

Referring primarily to FIG. 4, the shield or guard 20 can have a generally hollow tubular cage shaped body 30 having a substantially cylindrical inner central void 40 that can fit around and accommodate the outer shell 4 of a suppressor 1 and offer a modicum of protection to a suppressed firearm user from burns resulting from contact with the hot suppressor. The guard can have a proximal end 22 having a proximal opening 21 and an opposite distal end 23 having a distal opening 24. An axially medial portion can have a number of angularly, parallelly, and uniformly spaced apart elongated axial slits 25 that penetrate radially from an outer surface of the guard to the inner void. The slits provide enhanced ventilation to the suppressor. The slits can be located axially to reside directly radially outward from the heat radiating ridges 12 on the suppressor, thereby providing enhanced heat dissipation to those structures. Angularly adjacent slits can be separated by an elongated bridge 26. Each bridge can have a generally U-shaped cross-section taken perpendicular to the central axis 6 forming elongated parallel ridges 27 separated by an elongated trench 28. The ridges and trenches form a radially extending gripping surface for applying torque to the guard which can transfer to the engaged suppressor, and can provide an increased surface area as a heat radiator.

The guard 20 can be mounted upon the suppressor 1 by axially engaging the proximal end 2 of the suppressor through the distal opening 23 of the guard. Proximal axial movement of the guard with respect to the suppressor is stopped by the contact of a female conically beveled stop-surface 29 extending radially inwardly into the void of the guard running up against a corresponding male conically beveled shoulder 19 on the suppressor. The stop-surface and the shoulder have cooperative angles. In the present embodiment those angles are both 45 degrees. However, other cooperative angles can be used. For example, a stop-surface having a 30 degree angle can bear against a shoulder having a 60 degree angle. To be cooperating, the sum of these angles should be substantially 90 degrees.

Care must be taken to angularly orient the guard 20 with respect to the suppressor 1 so that angular alignment structures line up. In this embodiment a plurality of angularly spaced apart radially inwardly projecting lugs 41 on the guard can align with similarly shaped radially inwardly extending and angularly spaced apart notches 17 on the suppressor. Once engaged, the lugs can prevent angular movement of the guard with respect to the suppressor and thus are capable of transmitting torque from the guard to the suppressor.

Figure 9:
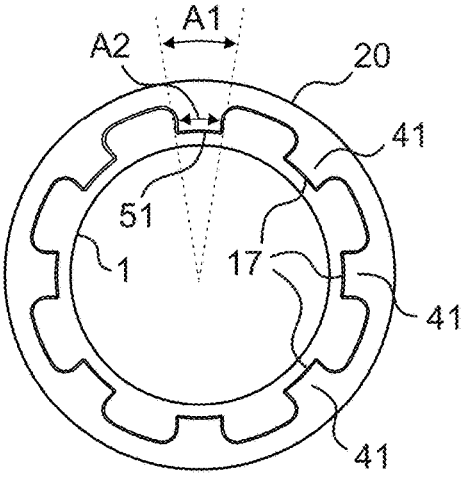
FIG. 9 is a diagrammatic cross-sectional end view of the lug and notch interface of the suppressor and ventilating heat shield of FIG. 2.
Figure 11:
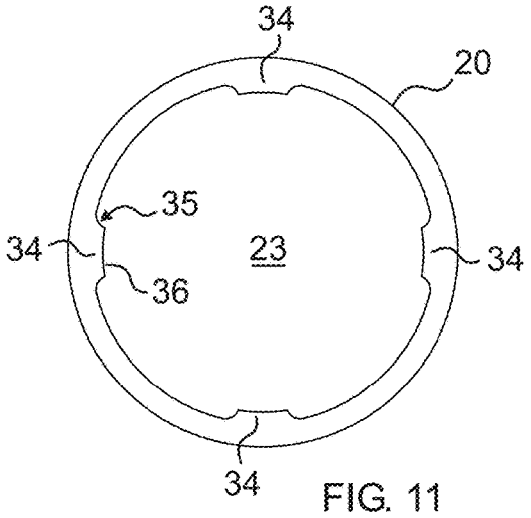
FIG. 11 is a diagrammatic cross-sectional end view of the distal bearing structure of the ventilating heat shield of FIG. 10.
Figure 10:
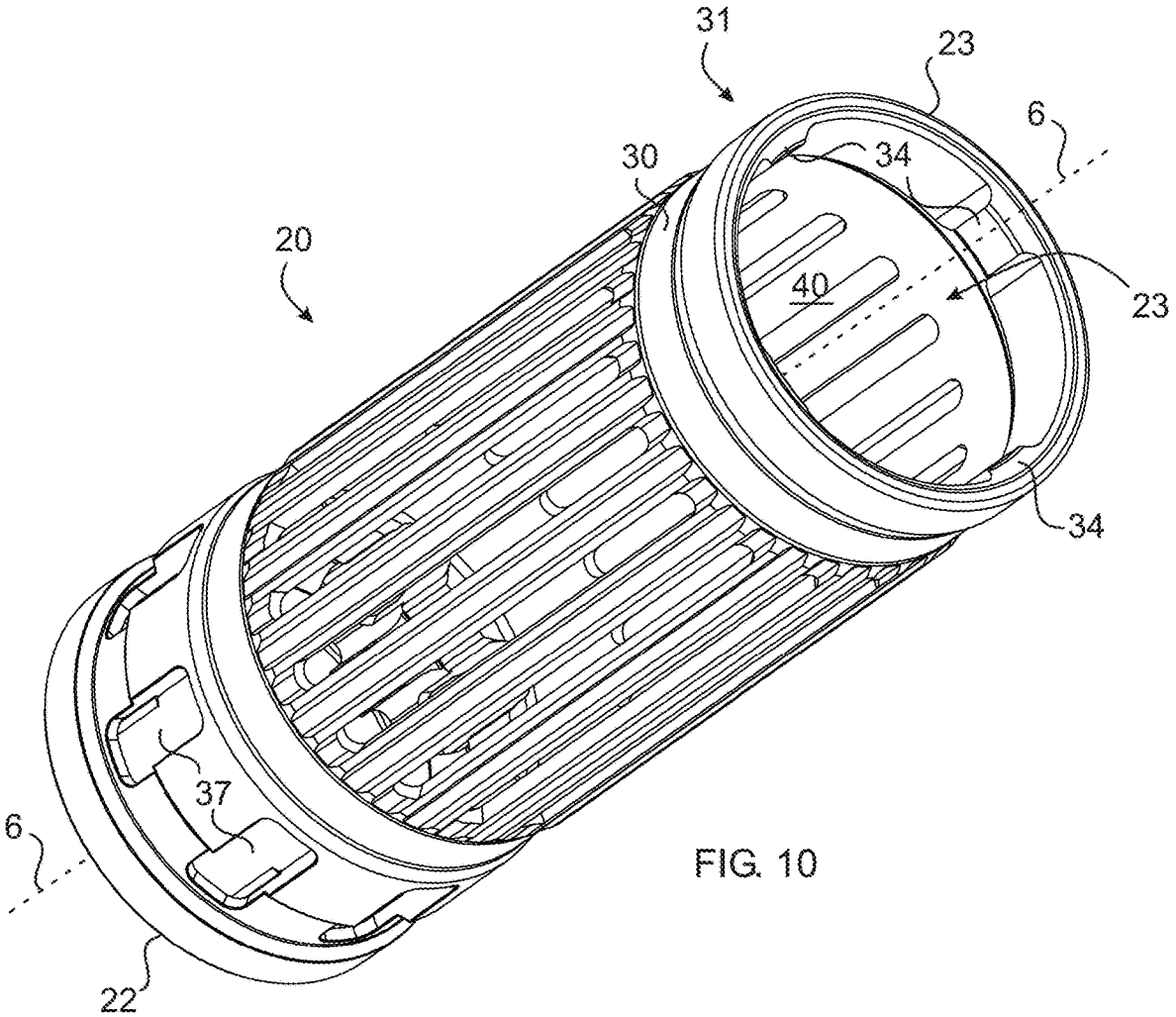
FIG. 10 is a diagrammatic bottom, front, right side perspective view of the ventilating heat shield of FIG. 1.

As shown more clearly in FIG. 9, each of the lugs 41 can have a radially inward facing surface 51 having a first angular dimension A1 that is wider than an angular dimension A2 of a more radially outward portion of the lug. This cross-sectional shape allows for the interface of 3D printed structures rather than those that are machined. In other words, the suppressor notches 17 can have a slight undercut because the adjacent surface is printed rather than machined, and that surface does not closely contact the adjacent surface on the suppressor.

Once the stop-surface 29 bears against the shoulder 19, the axial position of the guard 20 with respect to the suppressor 1 can be fixed and locked in place by engaging a locking snap-ring 60 within a circumferential peripheral groove 61 located near the proximal end of the suppressor. A wave spring 50 between the snap-ring and the disk-shaped axial bearing surface 62 on the guard can provide a forward bias to the guard against the beveled shoulder. The axial bearing surface can be axially recessed within a well 63 to improve aesthetics, avoid inadvertent contact with the user when these structures are hot, and avoid inadvertent removal or damage to the snap-ring or wave spring. The snap-ring can be split creating a space 65 separating opposing ends 66,67 allowing minor expansion to be fit into place. Grasping holes 68 provide a purchase on the opposing ends to manipulate the space. Similarly, the wave ring can be split creating a space 55 between opposing ends 56,57.

The guard 20 can mount to the suppressor 1 on a pair of axially spaced apart spoked bearings 31,32 located at the proximal and distal ends 22,23 of the guard. The bearings form bearing bores at either end of the guard through which the suppressor can be axially slid. The bearings are supported upon a pair of similarly axially spaced apart journals 14,15 on the suppressor. In other words, each spoked bearing can form an inner diameter that is sized to intimately engage and rest upon its respective journal having a commensurate outer diameter.

The proximal bearing 31 can have a plural number of radially inwardly projecting proximal standoff spokes 33. The proximal spokes can be equidistantly angularly spaced apart to provide centering support for the guard upon the suppressor. Each proximal spoke can have a radially inward facing surface that has a substantial cylinder section shape radiused to intimately nest against the curved outer surface of the suppressor at a proximal bearing journal 14. In this embodiment there are eight proximal spokes. Although different numbers of proximal spokes can be used, eight has been chosen to conveniently match the number of mounting lugs and allow their angular alignment. A similar plural number of radial vents 37 can exist between the angular position of the lugs and proximal spokes to further ventilate the suppressor near its proximal end where the highest energy gasses occur. Each radial vent can extend through the guard from its outer surface to its central void.

The distal bearing 32 can have a plural number of radially inwardly projecting distal standoff spokes 34. The distal spokes can be equidistantly angularly spaced apart to provide centering support for the guard upon the suppressor. Each distal spoke can have a radially inward facing surface 36 that has a substantial cylinder section shape radiused to intimately nest against the curved outer surface of the suppressor at a distal bearing journal 15. Both the proximal spokes and distal spokes can have a rounded interface 35 to the guard to help avoid fouling.

Figure 7:
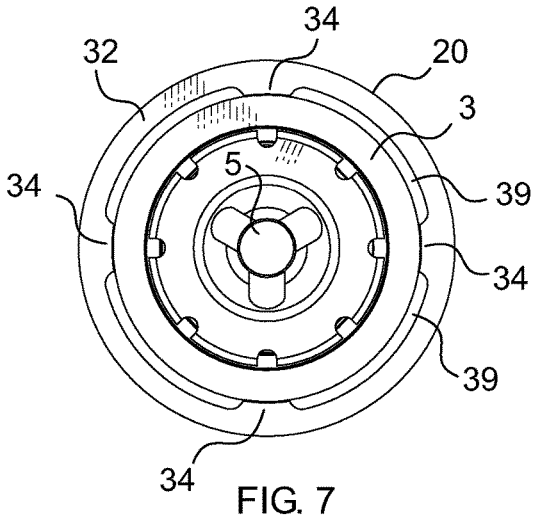
FIG. 7 is a diagrammatic front end view of the suppressor and ventilating heat shield of FIG. 2.
Figure 8:
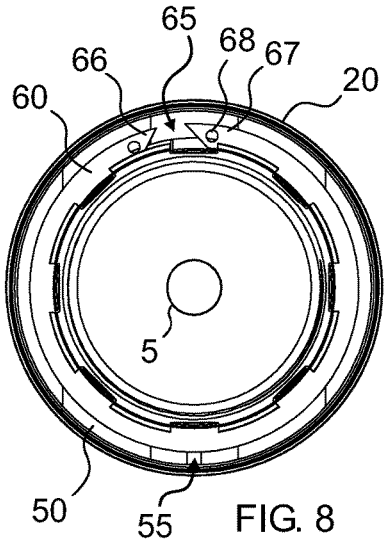
FIG. 8 is a diagrammatic back end view of the suppressor and ventilating heat shield of FIG. 2.

As shown primarily in FIG. 7, the distal stand-off spokes 34 create ventilation gaps 39 at the distal face of the suppressor and guard combination to further enhance heat dissipation.

The above-described embodiment provides a suppressor and heat protective ventilating guard which includes a plurality of internal lugs, and an angular bearing or stop surface, a cylindrical rear bearing bore, and a cylindrical front bearing bore. Both the front and rear bearing bores are interrupted in nature to allow cool ambient air to enter the space between the can guard and the outer surface of the suppressor in an effort to cool the suppressor.

Further, the above-described arrangement of features allows for a 3D-printed ventilated heat guard with minimal machining and assembly.

Figure 12:
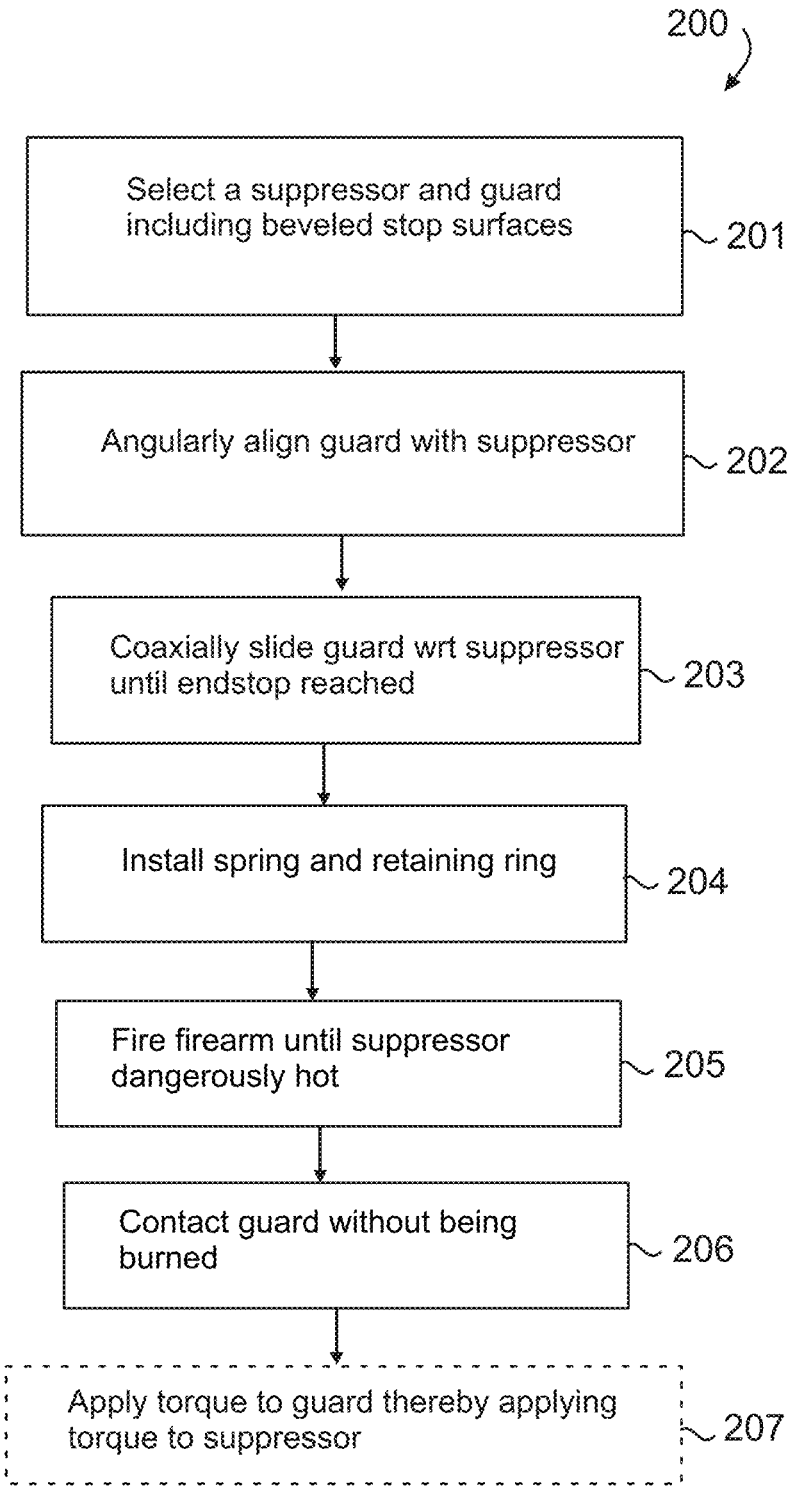
FIG. 12 is a flow chart diagram of a method for protecting a user from burns by a firearm suppressor according to an exemplary embodiment of the invention).

Referring now to FIG. 12, there is shown a method 200 for protecting a user from burns by a firearm suppressor according to an exemplary embodiment of the invention. The method can include selecting 201 a suppressor having a beveled shoulder on the surface of its outer shell, and a guard having a complimentary beveled stop surface extending into its inner void. The guard can be angularly aligned 202 with the suppressor so that inwardly radially projecting lugs on the guard can be aligned with corresponding notches on the suppressor. The proximal end of the suppressor can then be inserted into the distal opening of the guard and slid 203 coaxially until the beveled shoulder and beveled stop-surface contact one another. Once the beveled structures are fully seated a wave spring and retaining ring can be installed 204 at the proximal end of the suppressor and against the proximal end of the guard thereby locking the relative axial positions of the suppressor and guard. Once the guard is installed on the suppressor the firearm can be fired 205 repeatedly until the outer shell of the suppressor becomes dangerously hot. The user can then contact the guard 206 without being burned.

Alternately, the user can apply torque 207 to guard in order to remove the suppressor from the firearm.

The ventilating heat protecting guard can be installed on a firearm suppressor according to the following method as an exemplary embodiment of the invention. To install the guard, any mounting accessory must first be removed from the suppressor, thereby fully exposing the grooves in the rear of the suppressor. The guard can be installed from the rear and pushed forward until the angular bearing/stop surface inside the guard contacts the mating angular bearing/stop surface on the shoulder on the outside of the suppressor. The guard can be coaxially aligned on the suppressor by the relationship between the two bearing bores in the guard and the two mating bearing journals on the suppressor. To secure the guard on the suppressor, a wave spring is installed around the rear of the suppressor and positioned against an axial surface perpendicular to the central axis in the rear of the guard. A snap-ring is then placed over the rear of the suppressor and installed in a groove. When the snap-ring is seated in the groove, it will slightly compress the wave spring, and capture the guard against the angular bearing/stop surface. In order to remove the guard from the suppressor, the snap ring must be disengaged from its groove and removed, the wave spring removed, and the guard removed by sliding it off from the rear.

While the preferred embodiment of the invention has been described, modifications can be made and other embodiments may be devised without departing from the spirit of the invention and the scope of the appended claims.

What is claimed is:

1. The combination of a ventilating heat guard coaxially mounted to a firearm suppressor;

wherein said suppressor comprises:

an oblong outer shell having a central axial bore allowing the passage of a projectile therethrough from a proximal end to a distal end;

a radially outwardly projecting peripheral beveled shoulder;

wherein said heat guard comprises:

a body having an inner void shaped and dimensioned to accommodate said suppressor;

said body having a proximal opening to said void and a distal opening to said void;

a radially inwardly projecting beveled stop surface;

wherein said beveled stop surface bears against said beveled shoulder, preventing axial movement of said guard with respect to said suppressor in a first axial direction;

wherein said combination further comprises:

said guard further comprising a plurality of angularly spaced apart inwardly extending radial lugs located near a proximal end of said guard;

said suppressor further comprising a plurality of notches engaged by said lugs;

thereby preventing angular movement of said guard with respect to said suppressor.

2. The combination of claim 1, wherein said combination further comprises:

said beveled shoulder having a first bevel angle;

said beveled stop surface having a second bevel angle;

wherein a sum of said first bevel angle and said second bevel angle is substantially 90 degrees.

3. The combination of claim 2, wherein said first and second bevel angles are substantially 45 degrees.

4. The combination of claim 1, wherein said combination further comprises:

said suppressor further comprising:

a proximal journal;

a distal journal axially spaced apart from said proximal journal;

said guard further comprising:

a proximal bearing supported upon said proximal journal;

a distal bearing supported upon said distal journal.

5. The combination of claim 4, wherein said combination further comprises:

said proximal bearing having a proximal bearing inner diameter;

said distal bearing having a distal bearing inner diameter;

said proximal journal having a proximal journal outer diameter commensurate with said proximal bearing inner diameter;

said distal journal having a distal journal outer diameter commensurate with said distal bearing inner diameter.

6. The combination of claim 5, wherein said combination further comprises:

said proximal bearing having a first plural number of radially inwardly projecting angularly spaced apart proximal stand-off spokes;

said distal bearing having a second plural number of radially inwardly projecting angularly spaced apart distal stand-off spokes separating distal ventilation gaps.

7. The combination of claim 1, wherein said combination further comprises:

said guard further comprising a plurality of angularly spaced apart radial vents extending through said body to said inner void;

wherein said vents are located proximal to said beveled stop surface.

8. The combination of claim 1, wherein each of said lugs comprises a radially inward facing surface having a first angular dimension that is wider than an angular dimension of a more radially outward portion of said lug.

9. The combination of a ventilating heat guard coaxially mounted to a firearm suppressor;

wherein said suppressor comprises:

an oblong outer shell having a central axial bore allowing the passage of a projectile therethrough from a proximal end to a distal end;

a radially outwardly projecting peripheral beveled shoulder;

wherein said heat guard comprises:

a body having an inner void shaped and dimensioned to accommodate said suppressor;

said body having a proximal opening to said void and a distal opening to said void;

a radially inwardly projecting beveled stop surface;

wherein said beveled stop surface bears against said beveled shoulder, preventing axial movement of said guard with respect to said suppressor in a first axial direction;

wherein said combination further comprises:

a disk-shaped axial bearing surface located near said proximal opening;

and wherein said suppressor further comprises:

a circumferential groove near said proximal end;

a snap-ring resting within said groove;

a wave spring compressed between said snap-ring and said axial bearing surface.

10. The combination of claim 9, wherein said combination further comprises:

said axial bearing surface being located with a well extending distally from a distal end of said guard.

11. The combination of a ventilating heat guard coaxially mounted to a firearm suppressor;

wherein said suppressor comprises:

an oblong outer shell having a central axial bore allowing the passage of a projectile therethrough from a proximal end to a distal end;

a radially outwardly projecting peripheral beveled shoulder;

wherein said heat guard comprises:

a body having an inner void shaped and dimensioned to accommodate said suppressor;

said body having a proximal opening to said void and a distal opening to said void;

a radially inwardly projecting beveled stop surface;

wherein said beveled stop surface bears against said beveled shoulder, preventing axial movement of said guard with respect to said suppressor in a first axial direction;

wherein said combination further comprises:

said guard further comprising a plurality of axially oblong angularly spaced apart slits extending radially through said body from an outer surface to said void;

wherein said slits are located distal to said beveled stop-surface.

12. The combination of claim 11, wherein said combination further comprises:

said suppressor further comprising a heat radiator structure formed on said outer shell;

said guard further comprising said slits being located radially outward from said heat radiator structure.

13. A method for protecting a user from burns by a firearm suppressor, said method comprises:

selecting a suppressor having an outer shell having a beveled shoulder;

selecting a guard having an inner void that can accommodate said suppressor, and having complimentary beveled stop-surface extending into said void;

aligning said guard angularly with said suppressor so that angular alignment structures line up;

inserting coaxially a proximal end of said suppressor into a distal opening of said guard until said beveled shoulder contacts said beveled stop-surface;

locking the axial position of said suppressor with respect to said guard;

firing said firearm until said suppressor becomes dangerously hot;

touching the guard without being burned; and, applying torque to said guard to remove said guard from said suppressor while said suppressor is dangerously hot.

* * * * *